US007380782B2

(12) United States Patent
Lien

(10) Patent No.: US 7,380,782 B2
(45) Date of Patent: Jun. 3, 2008

(54) AUTOMATIC DOCUMENT FEEDER HAVING A REPLACEABLE FRICTION ROLLER ASSEMBLY

(75) Inventor: Szu Hui Lien, Hsinchu (TW)

(73) Assignee: Avision Inc. (TW)

( * ) Notice: Subject to any disclaimer, the term of this patent is extended or adjusted under 35 U.S.C. 154(b) by 389 days.

(21) Appl. No.: 11/167,198

(22) Filed: Jun. 28, 2005

(65) Prior Publication Data

US 2006/0001210 A1 Jan. 5, 2006

(30) Foreign Application Priority Data

Jul. 5, 2004 (TW) ..... 93120105 A

(51) Int. Cl.
*B65H 3/06* (2006.01)

(52) U.S. Cl. ..... 271/109; 271/10.09; 271/113; 271/114; 271/117; 271/314; 271/264

(58) Field of Classification Search ..... 271/109, 271/10.09, 113, 114, 117, 314, 375, 264; 384/295, 428, 439, 440; 403/348
See application file for complete search history.

(56) References Cited

U.S. PATENT DOCUMENTS 4,662,024 A * 5/1987 Moench ..... 15/230.19
4,739,358 A * 4/1988 Takahashi et al. ..... 396/622
4,990,022 A * 2/1991 Watanabe et al. ..... 403/349
5,040,779 A * 8/1991 Ogiri et al. ..... 271/109
5,044,800 A * 9/1991 Rosenthal ..... 400/660
5,048,661 A * 9/1991 Toye ..... 193/35 R
5,156,388 A * 10/1992 Morita ..... 271/109
5,205,655 A * 4/1993 Sato ..... 384/428
5,324,018 A * 6/1994 Miura et al. ..... 271/122
5,372,464 A * 12/1994 Bureller ..... 408/72 B
5,454,554 A * 10/1995 Boughton et al. ..... 271/9.01
5,595,382 A * 1/1997 Arai ..... 271/122
5,660,493 A * 8/1997 Stephens ..... 403/348
5,788,399 A * 8/1998 Smearsoll ..... 403/327
5,960,819 A * 10/1999 Weissinger et al. .... 137/315.11
6,030,127 A * 2/2000 Kang ..... 384/416
6,099,047 A * 8/2000 Reiff et al. ..... 292/4
6,332,715 B1 * 12/2001 Kuzuu et al. ..... 384/276
6,398,179 B1 * 6/2002 Soles ..... 248/617
6,488,276 B2 12/2002 Sheng et al.
7,152,858 B2 * 12/2006 Lin ..... 271/117
2002/0034348 A1 * 3/2002 Sampe ..... 384/295
2002/0190459 A1 * 12/2002 Gaarder et al. ..... 271/109

FOREIGN PATENT DOCUMENTS

CN 2446108 Y 9/2001

* cited by examiner

*Primary Examiner*—Patrick Mackey
*Assistant Examiner*—Prasad Gokhale

(57) ABSTRACT

An automatic document feeder (ADF) having a replaceable friction roller assembly. The ADF includes a housing having a back plate which may be raised and a base pivotalby connected to the back plate, a supporting element disposed on the housing and having a shaft hole, a first engaging structure disposed on the housing, and a friction roller assembly. The friction roller assembly includes a rotating shaft, a friction roller and a first sleeve. The friction roller is fixed to the rotating shaft. The first sleeve is rotatably mounted on the rotating shaft. The first sleeve has a second engaging structure which is engaged with the first engaging structure in order to rotatably and firmly mount the rotating shaft to the housing. The friction roller assembly may be replaced when the second engaging structure and the first engaging structure are disengaged.

13 Claims, 5 Drawing Sheets

AUTOMATIC DOCUMENT FEEDER HAVING A REPLACEABLE FRICTION ROLLER ASSEMBLY

BACKGROUND OF THE INVENTION

1. Field of the Invention

The invention relates to an Automatic Document Feeder (ADF) having a sleeve, which is rotatably mounted on a rotating shaft and has a second engaging structure which is engaged with and disengaged from a first engaging structure disposed on a housing such that a replaceable friction roller assembly of the ADF may be easily replaced by a user.

2. Description of the Related Art

A friction roller assembly on an ADF of a conventional scanner is a consumptive part, for it is depleted through transporting sheets, so the friction roller assembly has to be replaced after being used for a period of time, such that the sheet transporting quality may be maintained. However, a rotating shaft of the friction roller assembly is usually fixed to a back plate of the ADF using a fixing element such as a C-ring, which cannot be easily removed by users. So, the users cannot replace the friction roller assembly.

U.S. Pat. No. 6,488,276 discloses a paper feeding device having a replaceable paper conveying roller, wherein a rotating shaft is fit into an open shaft hole in conjunction with associated engaging structures such that the users can easily disassemble and replace the friction roller assembly. FIG. 5 is a schematic illustration showing the prior art ADF having a replaceable friction roller assembly. As shown in FIG. 5, a friction roller assembly 120 has a rotating shaft 122 and a friction roller 124, and the rotating shaft 122 is fit into a closed shaft hole 112 and an open shaft hole 114 of a back plate 110. A pressing element 116 is provided to rotatably mount the rotating shaft 122 into the open shaft hole 114.

In the '276 patent, however, directly mounting the rotating shaft into the open shaft hole in conjunction with the engaging operation of the engaging structure produces an additional radial force exerting on the rotating shaft to increase the friction force between the shaft hole and the rotating shaft. If only one open shaft hole for accommodating one end of the rotating shaft is formed at one side of the back plate, the rotating shaft may be slantingly biased, and the sheet transporting procedure cannot be performed smoothly.

SUMMARY OF THE INVENTION

It is therefore an object of the invention to provide an automatic document feeder (ADF) having a sleeve, which is rotatably mounted on a rotating shaft and has a second engaging structure which is engaged with and disengaged from a first engaging structure disposed on a housing, such that a replaceable friction roller assembly of the ADF may be easily replaced and the additional radial force may be eliminated to reduce the friction force between the shaft hole and the rotating shaft.

To achieve the above-mentioned object, the invention provides an automatic document feeder (ADF) having a replaceable friction roller assembly. The ADF includes a housing having a back plate which may be raised and a base pivotably connected to the back plate, a supporting element disposed on the housing and having a shaft hole, a first engaging structure disposed on the housing, and a friction roller assembly. The friction roller assembly includes a rotating shaft, a friction roller and a first sleeve. The friction roller is disposed onto the rotating shaft and fixed. The first sleeve is rotatably mounted on the rotating shaft. The first sleeve has a second engaging structure which is engaged with the first engaging structure in order to rotatably and firmly mount the rotating shaft to the housing. The friction roller assembly may be replaced when the second engaging structure and the first engaging structure are disengaged.

The first engaging structure and the second engaging structure may be engaged with each other through relative rotation or relative movement in order to reduce the undesired radial force produced during the engaging process.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention.

DETAILED DESCRIPTION OF THE INVENTION

In order to overcome drawbacks of the prior art mentioned hereinabove, in this invention, the mechanism for fixing the replaceable friction roller assembly is disposed on the sleeve. Thus, any other part for fixing the friction roller assembly may be omitted, and an unwanted extra radial force exerted on the rotating shaft of the friction roller assembly may be avoided.

Figure 1:
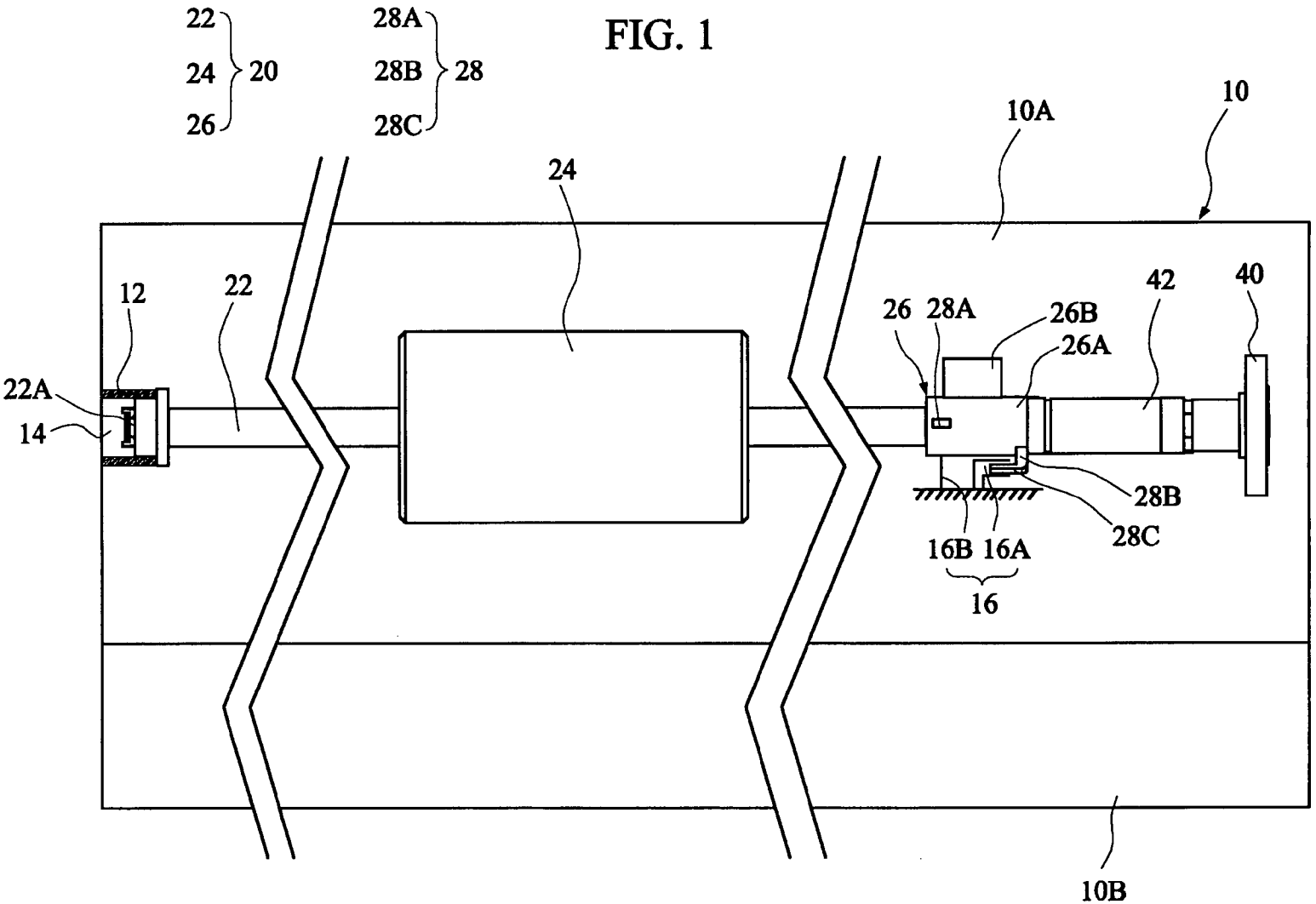
FIG. 1 is a schematic illustration showing an ADF having a replaceable friction roller assembly according to a first embodiment of the invention.
Figure 2:
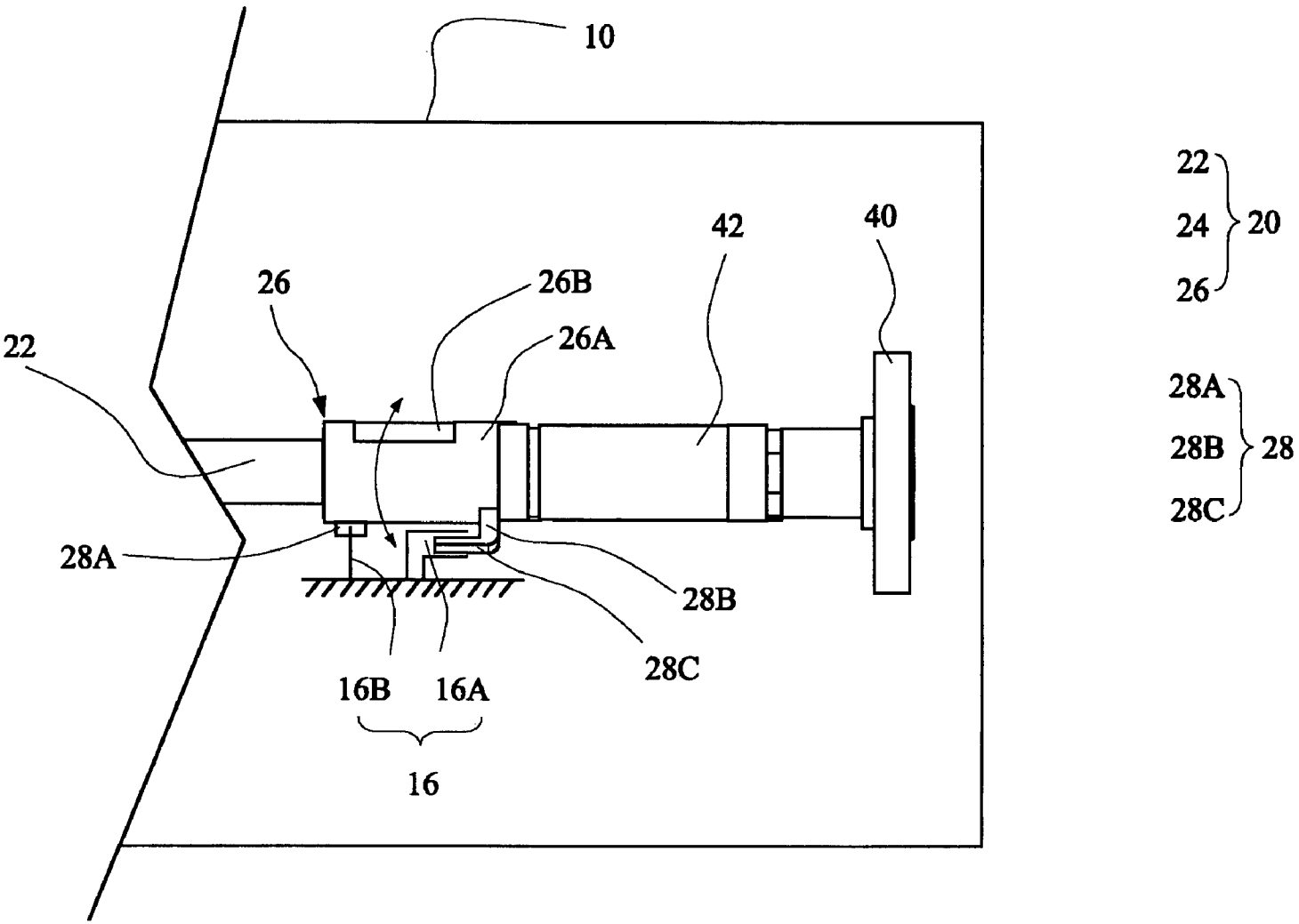
FIG. 2 is a partially enlarged view showing the ADF of FIG. 1.

FIG. 1 is a schematic illustration showing an automatic document feeder (ADF) having a replaceable friction roller assembly according to a first embodiment of the invention. FIG. 2 is a partially enlarged view showing the ADF of FIG. 1. Referring to FIGS. 1 and 2, an ADF having a replaceable friction roller assembly according to the first embodiment of the invention includes a housing 10, a supporting element 12, a first engaging structure 16 and a friction roller assembly 20. The housing 10 has a back plate 10A which may be raised and a base 10B pivotably connected to the back plate 10A. The back plate 10A covers over the base 10B when a sheet is being transported. The back plate 10A is raised when a paper jam has to be cleared, when the friction roller has to be cleaned or when the friction roller assembly has to be replaced.

In this embodiment, the supporting element 12 disposed on the back plate 10A has a shaft hole 14. The first engaging structure 16 is disposed on the back plate 10A. In another embodiment, however, the supporting element 12 and the first engaging structure 16 may also be disposed on the base 10B. The friction roller assembly 20 includes a rotating shaft 22, a friction roller 24 and a first sleeve 26. The rotating shaft 22 has a first end 22A disposed in the shaft hole 14. A gear 40 and a one-way clutch 42 may also be mounted on the rotating shaft 22 such that the sheet may be transported. The friction roller 24 is disposed onto the rotating shaft 22 and fixed. The rotating shaft 22 drives the friction roller 24 to rotate in order for the automatic document feeder to transport the sheet. The first sleeve 26 is rotatably mounted on the rotating shaft 22 and has a second engaging structure 28. The second engaging structure 28 is engaged with the first engaging structure 16 in order to rotatably and firmly mount the rotating shaft 22 on the back plate 10A of the housing 10. When the second engaging structure 28 and the first engaging structure 16 are disengaged, the friction roller assembly 20 may be replaced.

In this embodiment, the first engaging structure 16 and the second engaging structure 28 are engaged through relative rotation therebetween. Thus, the first engaging structure 16 has an arced slot 16A and an elastic rib 16B, and the second engaging structure 28 has a projection 28A and a radial part 28B, both of which are connected to an external circumferential surface 26A of the first sleeve 26, and an arced part 28C substantially parallel to the external circumferential surface 26A and connected to the radial part 28B. The arced part 28C is embedded into the arced slot 16A such that the arced part 28C is fit into the arced slot 16A and the elastic rib 16B is engaged with the projection 28A.

In order to facilitate the first sleeve 26 to be rotated, the first sleeve 26 further has an actuating part 26B to be actuated to rotate the second engaging structure 28 to engage with or disengage from the first engaging structure 16.

Figure 3:
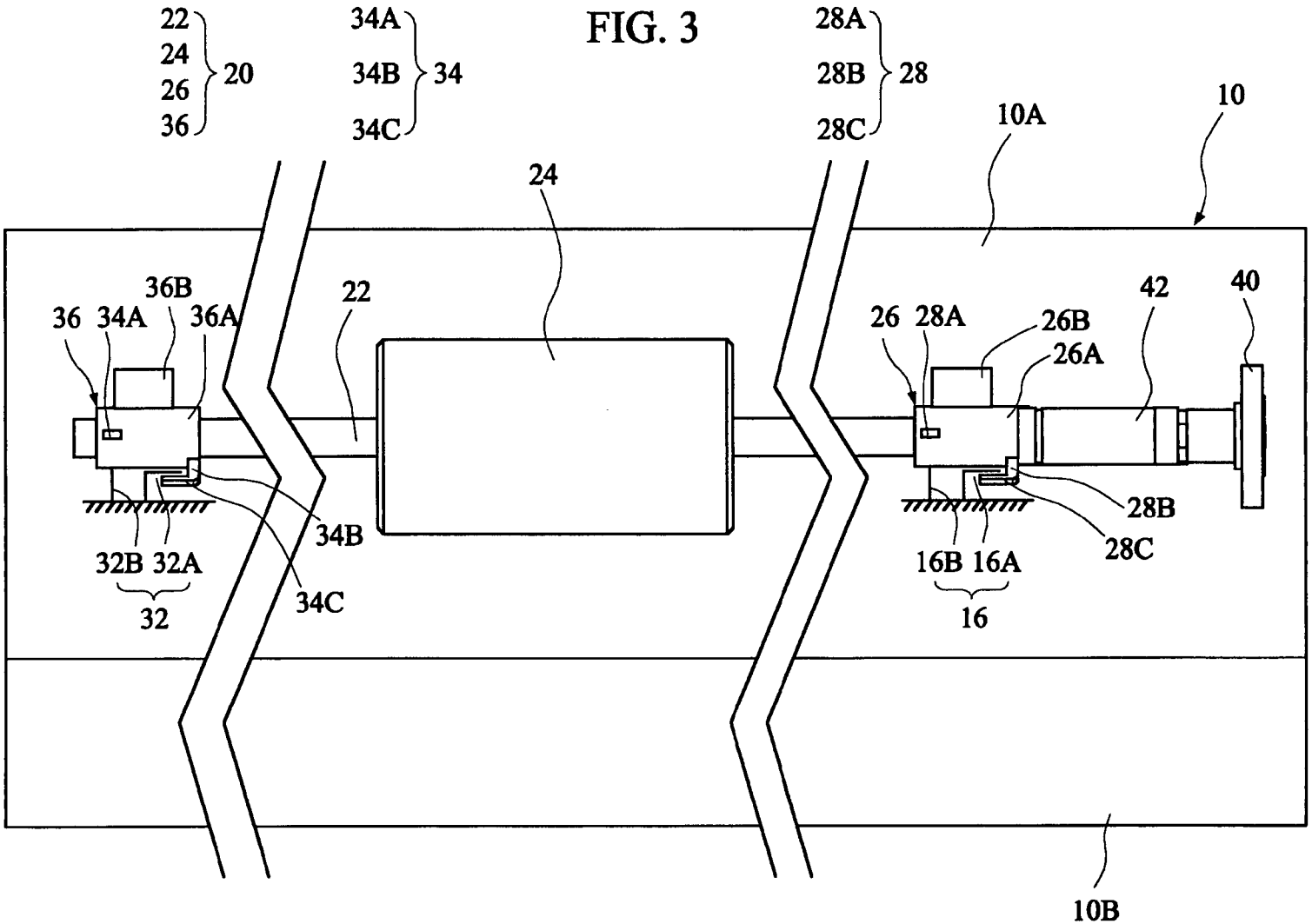
FIG. 3 is a schematic illustration showing an ADF having a replaceable friction roller assembly according to a second embodiment of the invention.

FIG. 3 is a schematic illustration showing an ADF having a replaceable friction roller assembly according to a second embodiment of the invention. Referring to FIG. 3, the ADF of this embodiment includes a housing 10 having a back plate 10A which may be raised and a base 10B pivotably connected to the back plate 10A. This ADF further includes a first engaging structure 16 and a third engaging structure 32, both of which are disposed on the back plate 10A, and a friction roller assembly 20. Similarly, the first engaging structure 16 and the third engaging structure 32 may also be disposed on the base 10B. The friction roller assembly 20 includes a rotating shaft 22, a friction roller 24, which is disposed onto the rotating shaft 22 and fixed, a first sleeve 26 having a second engaging structure 28, and a second sleeve 36 having a fourth engaging structure 34, wherein the rotating shaft 22 drives the friction roller 24 to rotate in order for the automatic document feeder to transport the sheet. The first sleeve 26 and the second sleeve 36 are rotatably mounted on the rotating shaft 22. The first engaging structure 16 and the third engaging structure 32 are engaged with the second engaging structure 28 and the fourth engaging structure 34, respectively, in order to rotatably and firmly mount the rotating shaft 22 on the back plate 10A of the housing 10. The friction roller assembly 20 may be replaced when the second engaging structure 28 and the first engaging structure 16 are disengaged and when the fourth engaging structure 34 and the third engaging structure 32 are disengaged.

Consequently, this embodiment adopts two sleeves in conjunction with two engaging structures to achieve the better mounting state. The first engaging structure 16 and the second engaging structure 28 are engaged through relative rotation therebetween, and the third engaging structure 32 and the fourth engaging structure 34 are engaged through relative rotation therebetween. The first engaging structure 16 and the second engaging structure 28 are engaged in the same manner as the first embodiment, and detailed descriptions thereof will be omitted. The third engaging structure 32 and the fourth engaging structure 34 are engaged in a manner similar to that between the first engaging structure 16 and the second engaging structure 28.

Consequently, the third engaging structure 32 has an arced slot 32A and an elastic rib 32B, and the fourth engaging structure 34 has an projection 34A and a radial part 34B, both of which are connected to an external circumferential surface 36A of the second sleeve 36, and an arced part 34C, which is substantially parallel to the external circumferential surface 36A and connected to the radial part 34B. The arced part 34C is embedded into the arced slot 32A such that the arced part 34C is fit into the arced slot 32A and the elastic rib 32B is engaged with the projection 34A.

Figure 4:
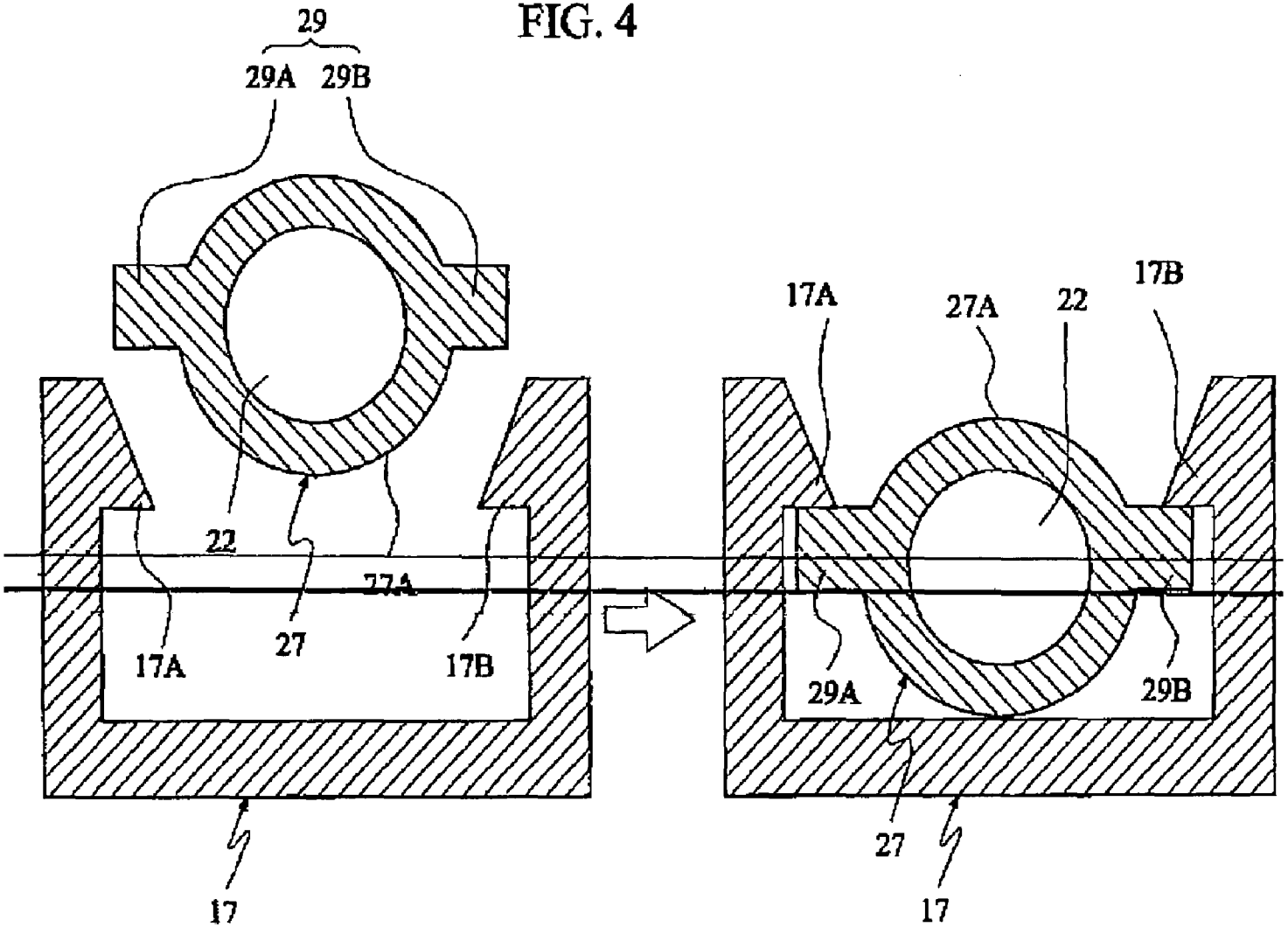
FIG. 4 is a schematic illustration showing an ADF having a replaceable friction roller assembly according to a third embodiment of the invention.
Figure 5:
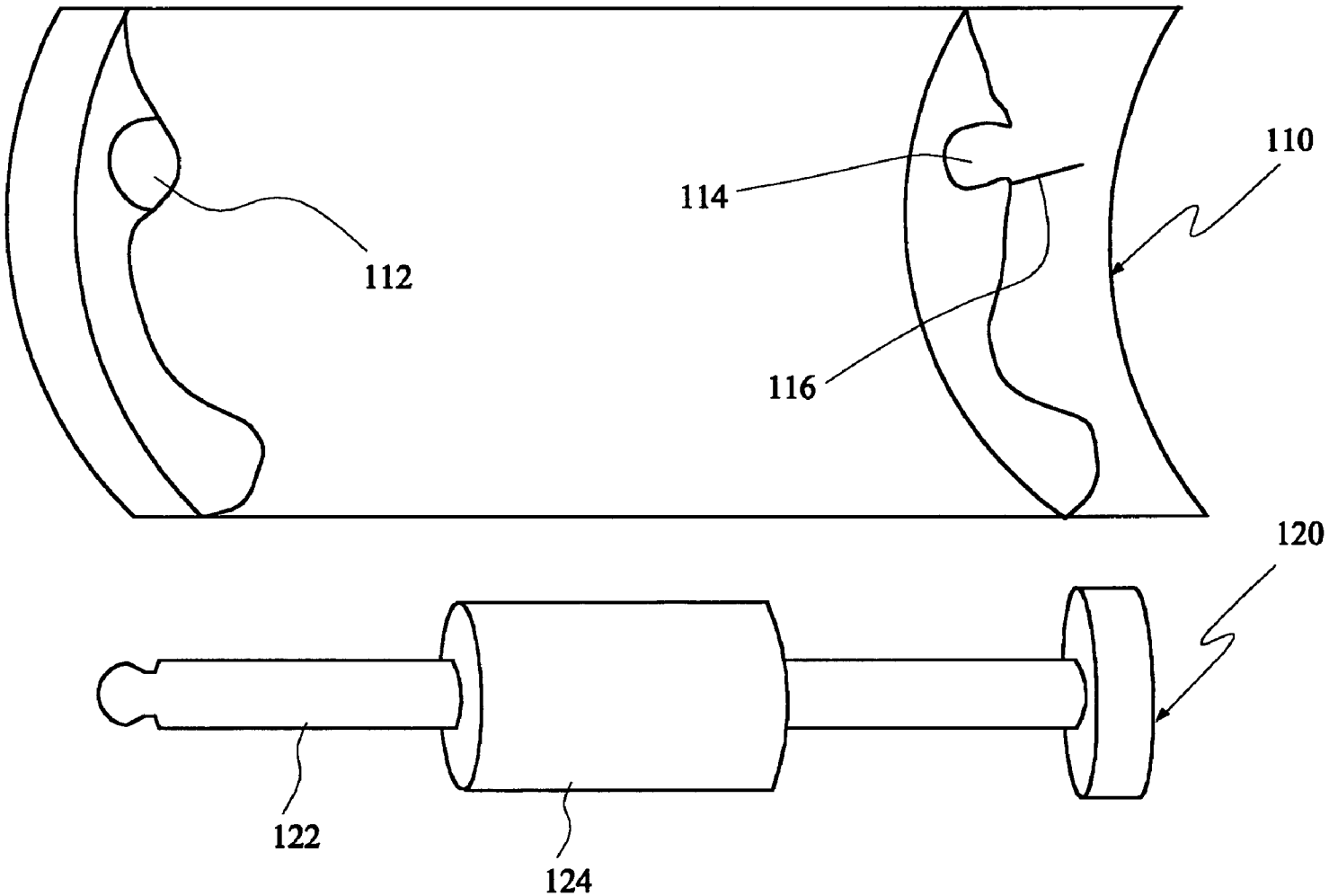
FIG. 5 (Prior Art)
FIG. 5 is a schematic illustration showing a prior art ADF having a replaceable friction roller assembly.

FIG. 4 is a schematic illustration showing an ADF having a replaceable friction roller assembly according to a third embodiment of the invention. As shown in FIG. 4, what is different from the first embodiment is that a first engaging structure 17 and a second engaging structure 29 are engaged through relative movement therebetween. Therefore, the first engaging structure 17 has two elastic hooks 17A and 17B, and the second engaging structure 29 has two wings 29A and 29B disposed on an external circumferential surface 27A of the first sleeve 27. The wings 29A and 29B are engaged with the elastic hooks 17A and 17B, respectively. The engaging method between the engaging structures of this embodiment may also be applied to the first and second embodiments, or one of the engaging portions of the second embodiment. Thus, the third engaging structure and the fourth engaging structure may also be engaged through relative movement therebetween.

According to the above-mentioned structures of the invention, it is possible to effectively reduce the friction force between the rotating shaft of the friction roller assembly and the shaft hole, and prevent the rotating shaft from being biased by the additional radial force. Thus, the friction roller assembly may be rotated more stably. In addition, mounting the sleeve on the shaft of the friction roller assembly can prevent the sleeve from falling down or being lost during the disassembling process. After the friction roller assembly is replaced with a new one, the new friction roller assembly with the new sleeve can ensure the rotating condition of the friction roller assembly. Furthermore, the invention prevents the torque of the friction roller assembly from being increased by the radial force produced by the fixing parts of the rotating shaft, and avoids the unsmooth rotation due to the curved and deformed rotating shaft caused by the radial force.

While the invention has been described by way of examples and in terms of preferred embodiments, it is to be understood that the invention is not limited to the disclosed embodiments. To the contrary, it is intended to cover various modifications. Therefore, the scope of the appended claims should be accorded the broadest interpretation so as to encompass all such modifications.

What is claimed is:

1. An automatic document feeder, comprising:

a housing having a back plate which may be raised and a base pivotably connected to the back plate;

a supporting element disposed on the housing and having a shaft hole;

a first engaging structure disposed on the housing; and a friction roller assembly, which comprises:

a rotating shaft, which has a first end disposed in the shaft hole;

a friction roller, which is disposed onto the rotating shaft and fixed, wherein the rotating shaft drives the friction roller to rotate in order for the automatic document feeder to transport a sheet; and a first sleeve, which is rotatably mounted on the rotating shaft and has a second engaging structure which is engaged with the first engaging structure in order to rotatably and firmly mount the rotating shaft on the housing, wherein the friction roller assembly may be replaced when the second engaging structure and the first engaging structure are disengaged, wherein;

the first engaging structure is engaged with the second engaging structure through relative rotation therebetween;

the first engaging structure has an arced slot and an elastic rib;

the second engaging structure has a projection and a radial part, both of which are connected to an external circumferential surface of the first sleeve, and an arced part, which is substantially parallel to the external circumferential surface and connected to the radial part;

the arced part is fit into the arced slot; and the elastic rib is engaged with the projection.

2. The automatic document feeder according to claim 1, wherein the first sleeve further has an actuating part to be actuated to rotate the second engaging structure to engage with or disengage from the first engaging structure.

3. An automatic document feeder, comprising:

a housing having a back plate which may be raised and a base pivotably connected to the back plate;

a first engaging structure and a third engaging structure, both of which are disposed on the housing; and a friction roller assembly, which comprises:

a rotating shaft;

a friction roller, which is disposed onto the rotating shaft and fixed, wherein the rotating shaft drives the friction roller to rotate in order for the automatic document feeder to transport a sheet; and a first sleeve having a second engaging structure and a second sleeve having a fourth engaging structure, wherein:

both of the first sleeve and the second sleeve are rotatably mounted on the rotating shaft;

the first engaging structure and the third engaging structure are respectively engaged with the second engaging structure and the fourth engaging structure in order to rotatably and firmly mount the rotating shaft on the housing; and the friction roller assembly may be replaced when the second engaging structure and the first engaging structure are disengaged and when the fourth engaging structure and the third engaging structure are disengaged.

4. The automatic document feeder according to claim 3, wherein the first engaging structure is engaged with the second engaging structure through relative rotation therebetween.

5. The automatic document feeder according to claim 4, wherein:

the first engaging structure has an arced slot and an elastic rib;

the second engaging structure has a projection and a radial part, both of which are connected to an external circumferential surface of the first sleeve, and an arced part, which is substantially parallel to the external circumferential surface and connected to the radial part;

the arced part is fit into the arced slot; and the elastic rib is engaged with the projection.

6. The automatic document feeder according to claim 4, wherein the third engaging structure and the fourth engaging structure are engaged through relative rotation therebetween.

7. The automatic document feeder according to claim 4, wherein the third engaging structure and the fourth engaging structure are engaged through relative movement therebetween.

8. The automatic document feeder according to claim 5, wherein the first sleeve further has an actuating part to be actuated to rotate the second engaging structure to engage with or disengage from the first engaging structure.

9. The automatic document feeder according to claim 5, wherein:

the third engaging structure has an arced slot and an elastic rib;

the fourth engaging structure has a projection and a radial part, both of which are connected to an external circumferential surface of the second sleeve, and an arced part substantially parallel to the external circumferential surface and connected to the radial part; and the arced part is fit into the arced slot and the elastic rib is engaged with the projection.

10. The automatic document feeder according to claim 3, wherein the first engaging structure and the second engaging structure are engaged through relative movement therebetween.

11. The automatic document feeder according to claim 10, wherein the first engaging structure has two elastic hooks, the second engaging structure has two wings disposed on an external circumferential surface of the first sleeve, and the wings are engaged with the elastic hooks, respectively.

12. The automatic document feeder according to claim 10, wherein the third engaging structure and the fourth engaging structure are engaged through relative movement therebetween.

13. The automatic document feeder according to claim 3, wherein the first engaging structure and the third engaging structure are disposed on the back plate or the base.

* * * * *